United States Patent [19]

Koski

[11] 3,942,798

[45] Mar. 9, 1976

[54] DISC TOSSING GAME

[76] Inventor: Dale H. Koski, 5 Russell Road, Apt. 4, Alexandria, Va. 22301

[22] Filed: Apr. 30, 1975

[21] Appl. No.: 573,074

[52] U.S. Cl. ..... 273/103; 273/105 R; 273/182 R; 273/127 C

[51] Int. Cl.[2] ..... A63B 71/02

[58] Field of Search .... 273/11 R, 11 C, 95 R, 95 D, 273/102 R, 103, 105 R, 105 A, 182 R, 182 A, 127 R, 127 C

[56] References Cited

UNITED STATES PATENTS

| | | | |
|---|---|---|---|
| 1,593,284 | 7/1926 | Arges | 273/11 R |
| 1,771,466 | 7/1930 | Scanlon | 273/182 A |
| 2,028,676 | 1/1936 | Light | 273/102 R |
| 2,062,166 | 11/1936 | Delwiche | 273/11 R |
| 2,513,667 | 7/1950 | Olson | 273/95 D |
| 3,643,950 | 2/1972 | Holk | 273/105 R |
| 3,790,174 | 2/1974 | Skillern | 273/103 |

*Primary Examiner*—Paul E. Shapiro
*Assistant Examiner*—Marvin Siskind
*Attorney, Agent, or Firm*—Roylance, Abrams, Berdo & Kaul

[57] ABSTRACT

An amusement apparatus used in conjunction with projectiles thrown at the apparatus including a plurality of target orifices, projectile receiving containers and tubes connecting the orifices and the containers. Each container is slidably supported in the apparatus so it can be pulled out thereof and the projectiles therein can be counted. A catch pan is mounted below the containers and an ejection mechanism is provided for ejecting the projectiles from the containers and allowing them to fall by gravity into the catch pan for easy retrieval.

10 Claims, 10 Drawing Figures

DISC TOSSING GAME

The present invention relates to an amusement apparatus, and more particularly relates to a projectile tossing game in which a plurality of projectiles, such as discs, are sequentially thrown at a plurality of targets having point value indicia associated therewith.

Although there have been many projectile tossing games in the prior art, they have routinely been lacking in two respects. First, many of these games have a plurality of target orifices which have tubes leading therefrom and dispensing the various projectiles passing therethrough in a common container. In such a device, it is difficult to keep score of the game since all of the projectiles come to rest in a common area and the only way of knowing what any one individual has scored is to add the point values associated with each target orifice as the projectile passes therethrough. However, sometimes it is not readily ascertainable as to which target orifice has been penetrated by a projectile and the cumulative score of each player must be kept during that player's turn.

Secondly, many games provide a plurality of target orifices and a separate container for each orifice wherein a projectile thrown through the orifice comes to rest in that container associated with the orifice. However, this necessitates a plurality of separate containers, and while score keeping is rather simple by counting the projectiles in the containers, retrieval of the plurality of projectiles from the plurality of containers is time consuming and difficult.

It is therefore an object of the present invention to overcome the limitations and drawbacks associated with the aforesaid prior art games and to provide a new and improved amusement apparatus for use in conjunction with projectiles tossed thereat.

Another object of the present invention is to provide an inexpensive, portable and enjoyable amusement device.

A further object of the present invention is to provide a disc tossing game in which a plurality of containers are provided so that the score of each participant may be readily ascertained and an ejection mechanism is also provided so that the projectiles in the containers can be ejected therefrom and collected in a single catch pan for easy retrieval.

The foregoing objects are attained by providing an amusement apparatus used in conjunction with projectiles thrown towards the apparatus, the combination comprising a substantially horizontal base wall; an upstanding wall coupled to said base wall; a plurality of target orifices located in the upstanding wall at which a plurality of projectiles are sequentially thrown; point value indicia associated with each of the target orifices; a plurality of projectile receiving means, located above the base wall and below the target orifices, for receiving the projectiles passing through the target orifices, each one of the plurality of receiving means being associated with at least one of the target orifices; channel means for selectively conducting projectiles passing through the target orifices from each of the target orifices into the receiving means associated therewith; and a plurality of drawer means each for slidably supporting at least a part of one of the plurality of projectile receiving means between a first position wherein the part of the receiving means is on a first side of the upstanding wall and can receive a projectile from the channel means, and a second position wherein the part of the receiving means at least partially extends past the second side of the upstanding wall and projectiles therein are visible, each of the drawer means having point value indicia associated therewith corresponding to the point value indicia associated with the target orifice associated with the receiving means slidably supported thereby.

Other objects, advantages and salient features of the present invention will become apparent from the following detailed description, which, taken in conjunction with the annexed drawings, discloses a preferred embodiment of the present invention.

Referring now to the drawings which form a part of this original disclosure:

Figure 1:
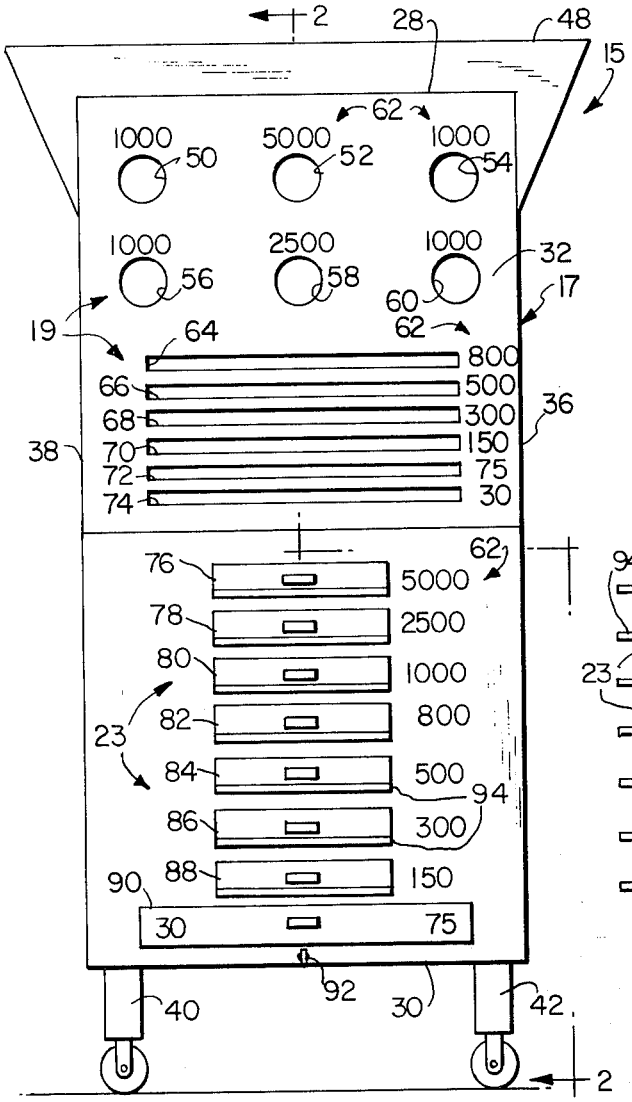
FIG. 1 is a front elevational view of an amusement apparatus in accordance with the present invention.

Referring to the drawings in further detail, the overall apparatus 15, as shown in FIGS. 1–4, is comprised of an outer housing 17, a plurality of target orifices 19, a plurality of channels 21, a plurality of drawers 23, and a plurality of projectile receiving assemblies 25.

The outer housing 17 is comprised of a top wall 28, a bottom base wall 30, an upstanding front wall 32, an upstanding rear wall 34, a right side wall 36 and a left side wall 38. All of these walls are preferably planar and rectangular, thereby defining a hollow interior within the outer housing 17 having a substantially rectangular cross section.

The apparatus 15 is rendered portable by having the base wall 30 supported on four upright legs 40, 42, 44, and 46 located in each corner of the base wall, each of these legs having a wheel rotatably supported at the bottom thereof.

Figure 2:
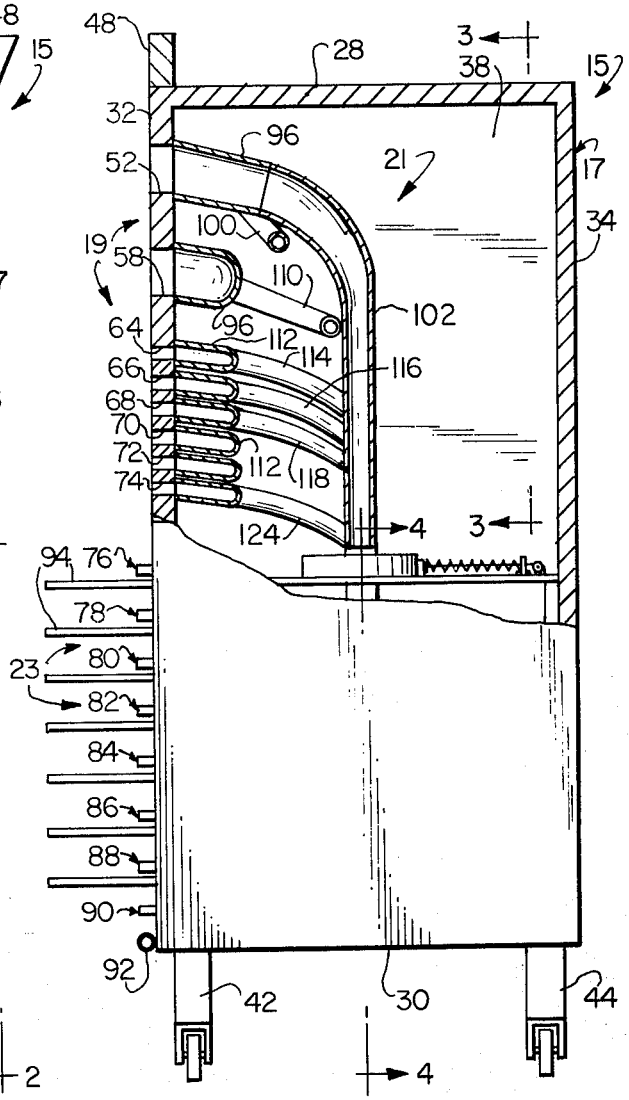
FIG. 2 is a sectional view in elevation taken along lines 2—2 in FIG. 1.
Figure 3:
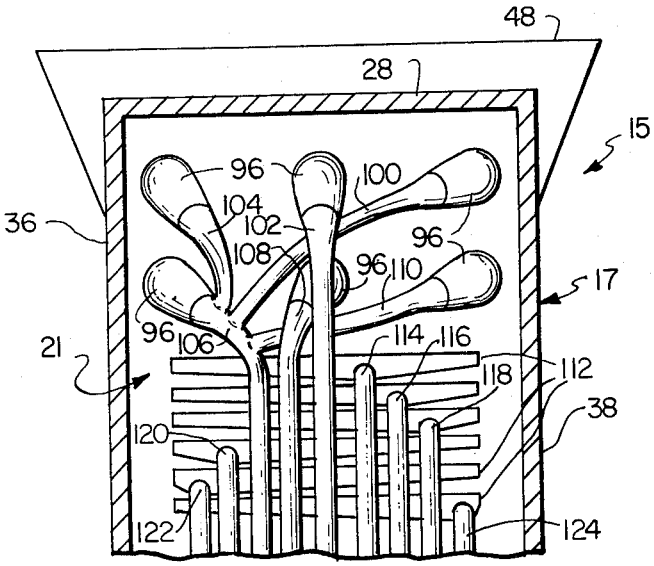
FIG. 3 is a sectional view in elevation taken along lines 3—3 in FIG. 2.

As seen in FIGS. 1–3, a shield 48 is mounted on the front of the top wall 28 to deflect inaccurately thrown projectiles.

As best seen in FIGS. 1 and 2, the plurality of target orifices include six circular orifices 50, 52, 54, 56, 58 and 60 located near the top of the upstanding front wall 32 and passing completely through that wall. A point value indicia of "5000" is associated with target orifice 52, point value indicia of "2500" is associated with target orifice 58, and a point value indicia of "1000" is associated with each of the target orifices 50, 54, 56 and 60. Preferably each point value indicia 62 is painted or otherwise attached to the upstanding front wall 32 of the apparatus adjacent to its associated orifice.

Additionally, the target orifices 19 include six horizontally oriented, spaced parallel elongated slots 64, 66, 68, 70, 72, and 74 passing completely through the upstanding front wall 32 in a position below the circular orifices. Each of these slotted target orifices has a point value indicia 62 associated therewith and, as seen in FIG. 1, value "800" is associated with slot 64, value "500" is associated with slot 66, value "300" is associated with slot 68, value "150" is associated with slot 70, value "75" is associated with slot 72 and value "30" is associated with the bottom slot 74. Preferably, these point value indicia are painted on the upstanding front wall 32 adjacent the associated slot, or provided thereon in any other suitable fashion.

Below the slotted orifices in the upstanding front wall 32 are the plurality of drawers 23 including a first drawer 76, a second drawer 78, a third drawer 80, a fourth drawer 82, a fifth drawer 84, a sixth drawer 86 and a seventh drawer 88. Point value indicia 62 are associated with each of the seven drawers in such a fashion that the first drawer 76 is associated with value 5000, the second drawer 78 is associated with value 2500, the third drawer 80 is associated with value 1000, the fourth drawer 82 is associated with value 800, the fifth drawer 84 is associated with value 500, the sixth drawer 86 is associated with value 300 and the seventh drawer 88 is associated with value 150. Once again, these point value indicia 62 can be painted onto or otherwise adhered to the front of the upstanding front wall 32, or alternatively in this situation the point value indicia can be placed directly on the front of each of its associated drawer.

Below the seventh drawer 88 is a catch pan 90 which is wider than the other drawers and has a point value of 30 on its left hand side and a point value 75 on its right hand side.

Mounted below the catch pan 90 is a handle 92 whose function will be described in more detail hereinafter.

As best seen in FIGS. 1 and 2, a plurality of shelves 94 are rigidly secured to the upstanding front wall 32 below each one of the seven drawers contained therein. As seen in FIG. 2, these shelves 94 are substantially planar and are parallel.

Referring to FIGS. 2 and 3, the channels 21 for the circular target orifices are shown as comprising a hollow housing 96 mounted to the rear of the upstanding front wall 32 in a concentric relationship to each of the circular orifices and a tube communicating with each of the hollow housings. Preferably, all of the circular target orifices are of the same size and therefore the hollow housings 96 are all the same. Each of the hollow housings has a tube communicating with the hollow interior thereof including tube 100 associated with orifice 50, tube 102 associated with orifice 52, tube 104 associated with orifice 54, tube 106 associated with orifice 60, tube 108 associated with orifice 58 and tube 110 associated with orifice 56.

As best seen in FIG. 3, tubes 110, 104 and 110 communicate with tube 106 which extends downwardly in a vertical path below such communication. Thus, any projectile passing into the target orifices associated with tubes 100, 104, 106 and 110 all pass ultimately down tube 106.

All of the hollow housings 96 are curved downwards and have walls sloping towards the communication with its respective tube so that any projectile entering a circular orifice associated therewith passes from the hollow housing into the tube and then downwards as viewed in FIG. 3.

As shown in FIGS. 2 and 3, the slotted targets located below the circular targets each have a hollow housing 112 rigidly mounted in a position surrounding the opening of the slotted orifice on the inside of the upstanding wall 32. Each of these hollow housings 112 slopes downwardly and converges towards an outlet therein in which a vertically oriented tube is located. Thus, the slotted target orifices 64, 66, 68, 70, 72, and 74 communicate via each of the hollow housings 112 respectively with a vertically oriented tube 114, 116, 118, 120, 122, and 124.

Figure 4:
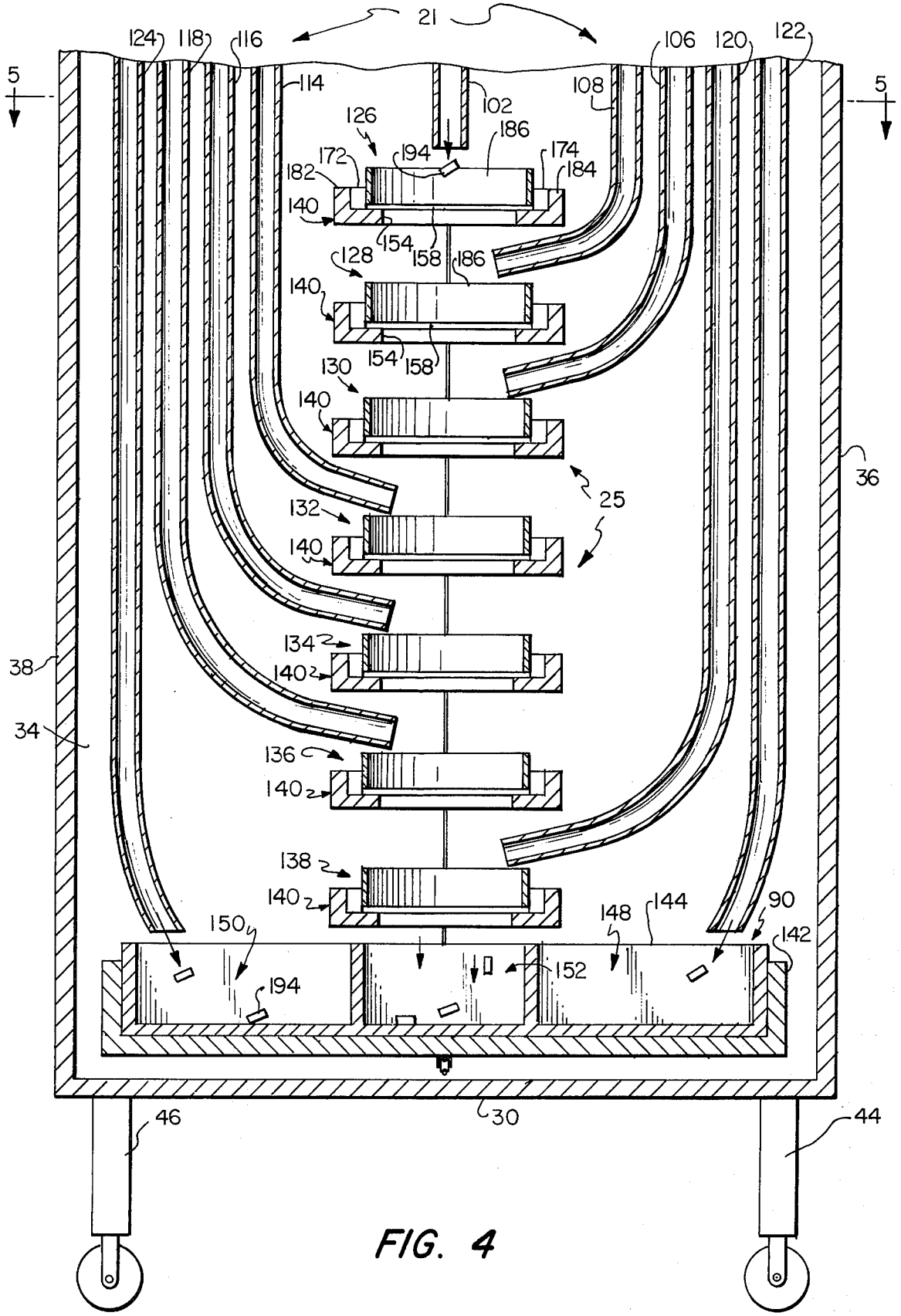
FIG. 4 is a sectional view in elevation taken along lines 4—4 in FIG. 2.

Referring specifically to FIG. 4, the plurality of projectile receiving assemblies 25 are shown therein to include seven of these assemblies 126, 128, 130, 132, 134, 136, and 138. These assemblies are supported in a spaced configuration one below the other in a vertical line within the outer housing 17 by means of a plurality of intermediate support members 140, all of which are the same and all of which extend between the inside of the upstanding front wall 32 and the inside of the upstanding rear wall 34. These members are rigidly supported to these walls and are in a spaced substantially parallel position relative to each other.

As best seen in FIG. 4, the bottom outlets of the tubes leading from the hollow housings 96 and 112 associated with the various target orifices are in such a position such that a projectile passing through the tube will enter the projectile receiving assembly associated therewith. Thus, each of the projectile receiving assemblies is thereby associated with at least one of the target orifices, projectile receiving assembly 130 being associated with the four circular target orifices 50, 54, 56, and 60 via main tube 106. Accordingly, projectile receiving assembly 126 is associated with tube 102, assembly 128 is associated with tube 108, assembly 138 is associated with tube 120, assembly 132 is associated with tube 114, assembly 134 is associated with tube 116 and assembly 136 is associated with tube 118.

Figure 6:
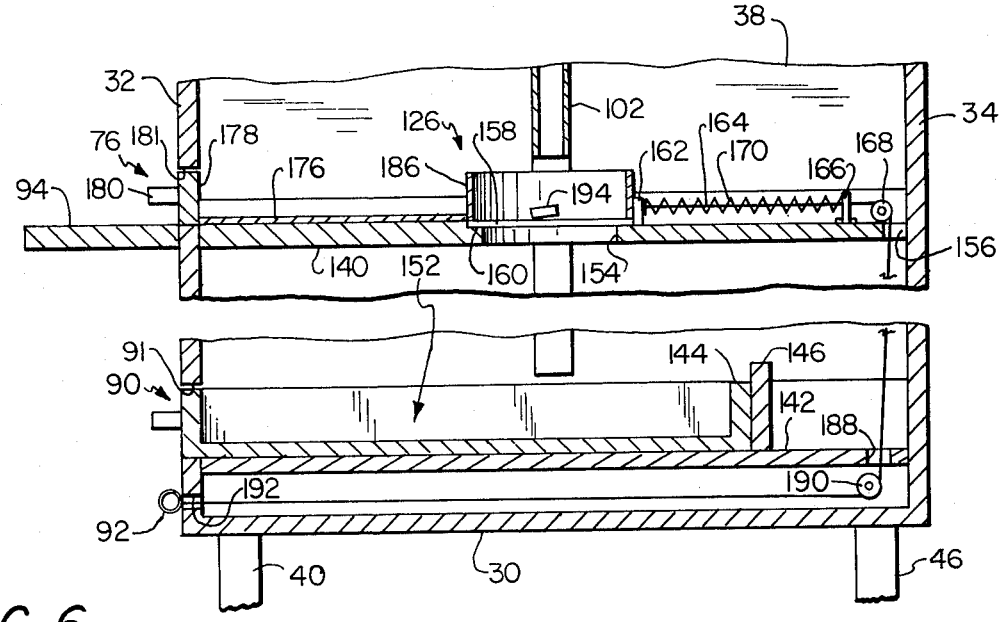
FIG. 6 is a sectional view in elevation taken along lines 6—6 in FIG. 5.

Additionally, the catch pan 90 is supported below the plurality of projectile receiving assemblies 25 on a bottom support member 142 which, as seen in FIG. 6, extends between the upstanding front wall 32 and the upstanding rear wall 34. The catch pan 90 is slidably received in that bottom support member 142 and extends into the outer housing 17 until its rear wall 144 contacts wall 146 coupled to the bottom support member 142 in a upright position. Catch pan 90 is slidable through the front wall 32 via rectangular aperture 91 therein.

As seen in FIG. 4, the catch pan 90 is divided into three sections, a right section 148 located below the outlet of tube 122, a left section 150 located below the outlet of tube 124 and a center section 152 located below the last of the projectile receiving assemblies. Thus, any projectile passing through tube 122 comes to rest in the right section 148 of the catch pan and any projectile passing through tube 124 comes to rest in the left section 150 of the catch pan. Thus, the right section 148 is associated with slotted target orifice 72 having a point value of 75 and is labeled as such on the front of the catch pan is seen in FIG. 1. Additionally, the left section 150 of the catch plan is associated with slotted target orifice 74 having a point value of 30 as indicated on the front of the catch pan as seen in FIG. 1.

Figure 5:
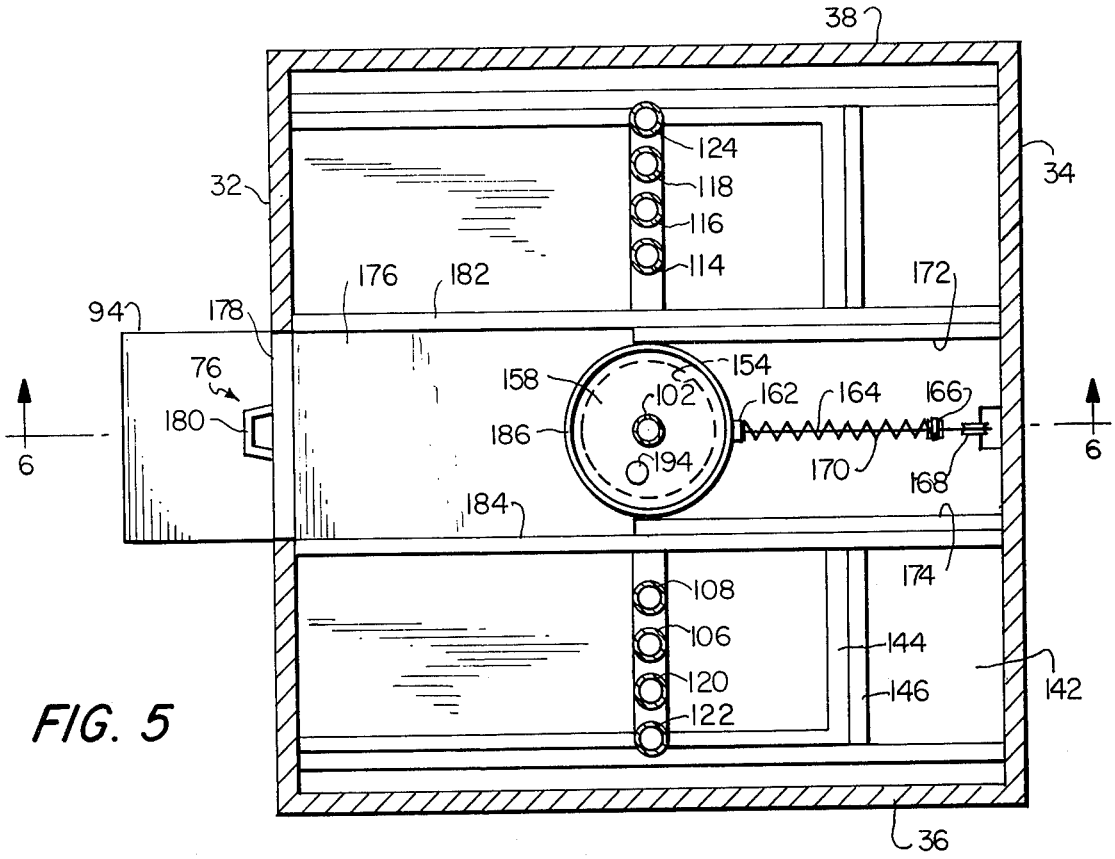
FIG. 5 is a sectional view in top plan taken along lines 5—5 in FIG. 4.

Referring now to FIGS. 5 and 6, the specific construction and operation of projectile receiving assembly 126 and its associated drawer 76 will be described, it being realized that the remainder of the projectile receiving assemblies and drawers are constructed and operate in substantially the same manner and therefore will not be separately described.

The intermediate support member 140 supporting projectile receiving assembly 126 has a central circular aperture 154 therein and a substantially rectangular passageway 156 therein adjacent the upstanding rear wall 34.

As seen in FIGS. 5 and 6, the aperture 154 is covered by a circular bottom member 158 having a diameter somewhat larger than that aperture. The bottom member 158, in its rest position shown in FIGS. 5 and 6, is received on the left side of aperture 154 in a small recess 160 formed in the intermediate support member 140 and is supported on the right hand side on the intermediate support member 140 itself which is reduced in thickness. Rigidly secured on the right side of the bottom member 158 is an upstanding plate 162 which rigidly receives the end of a cord or wire 164 which extends through an orifice in a second plate 166 rigidly secured to the top of the intermediate support member 140 adjacent the rectangular passageway 156. A roller 168 is interposed between the second plate 166 and the lip of the rectangular passageway 156 and the cord 164 passes from the aperture in the second plate 166 around the roller 168 and then down through the rectangular passageway 156. A compression spring 170 surrounds the cord 164 between the plates 162 and 166, thereby biasing the bottom member 158 to the left as seen in FIG. 5.

Two guide bars 172 and 174 are fixidly secured at opposite sides of the intermediate support member 140, the distance between these bars being equal to the diameter of the circular bottom member 158. These bars extend from the upstanding rear wall 34 to a position somewhat past the center of the intermediate support member 140.

Drawer 76, shown in FIGS. 5 and 6 is comprised of a bottom plate 176, a vertical plate 178 rigidly secured to the left hand side of the bottom plate, and a handle 180 rigidly secured in the middle of the vertical plate 178 and extending outward from the upstanding front wall 32. The vertical plate 178 is received in a rectangular aperture 181 formed in the upstanding front wall 32 and is slightly smaller than that aperture. The bottom plate 176 extends between the two upstanding side walls 182 and 184 defined on the sides of the intermediate support member 140 and extends from the rectangular aperture 181 to the ends of the guide bars 172, 174, as shown in FIG. 6.

Rigidly coupled to the rear end of the bottom plate 176 is a cylindrical housing 186 which is supported on top of the bottom member 158, this member thereby closing the bottom opening of the open ended housing 186.

As seen in FIG. 6, the container formed by the housing 186 and the bottom member 158 can receive projectiles delivered from tube 102.

Since the housing 186 is rigidly secured to the bottom plate 176 of the drawer 76, if the drawer is pulled to the left as shown in FIG. 6, the housing 186 moves in that direction. The shelf 94 extends outwardly from the upstanding front wall 32 at the same level as the bottom of the bottom plates 176 of the drawer 76, so that the drawer can be pulled outward from the upstanding front wall 32 onto that shelf 94.

The cord 164, after extending downward through the rectangular passageway 156 is coupled to a plurality of similar cords which are in turn coupled to a plurality of similar bottom members 158 for each of the projectile receiving assemblies shown in FIG. 4. Below the last of these assemblies 138 the cord, as shown in FIG. 6, passes through a passageway 188 in the bottom support member 142 around a roller 190 located on the bottom of the bottom support member 142 adjacent that passageway and extends horizontally towards and then out an aperture 192 in the upstanding front wall 32. The cord 164 is rigidly secured to the handle 92 on the outside of the upstanding front wall 32. This handle is larger than the aperture 192 and therefore cannot pass through the front wall 32. Because of this construction, pulling of the handle 92 away from the upstanding front wall 32 causes the plurality of bottom members 158 associated with each of the projectile receiving assemblies to move from its position shown in FIG. 6 towards the rear wall 34, thereby opening the bottom end of the housings 186 so that they communicate with apertures 154 in each of the intermediate support members 140.

In playing the game provided by the apparatus described above, the player takes a position in front of the front of the apparatus and sequentially tosses a plurality of projectiles, preferably in the form a discs such as coins towards the various target orifices in the upstanding front wall 32 and tries to obtain the highest point value possible by having the projectiles pass through the target orifices having the highest point value. It is contemplated that upwards of 12 to 15 discs will be thrown by each player. While many of the discs will fail to enter the target orifices, those that do pass through the orifice, into the hollow housings 96 or 112 and then are conducted downwardly via the plurality of tubes shown in FIGS. 2, 3 and 4. As each disc exits from a tube it will enter the containers formed by the plurality of projectile receiving assemblies 25 or the right and left sections 148, 150 of the catch pan, depending upon which orifice the disc enters.

Once the player has thrown all of the allotted projectiles, that player proceeds to add up the score attained by checking each of the projectile receiving assemblies and the catch pan and counting the number of projectiles in each, multiplying the correct point value times the number and then adding these values together.

Figure 7:
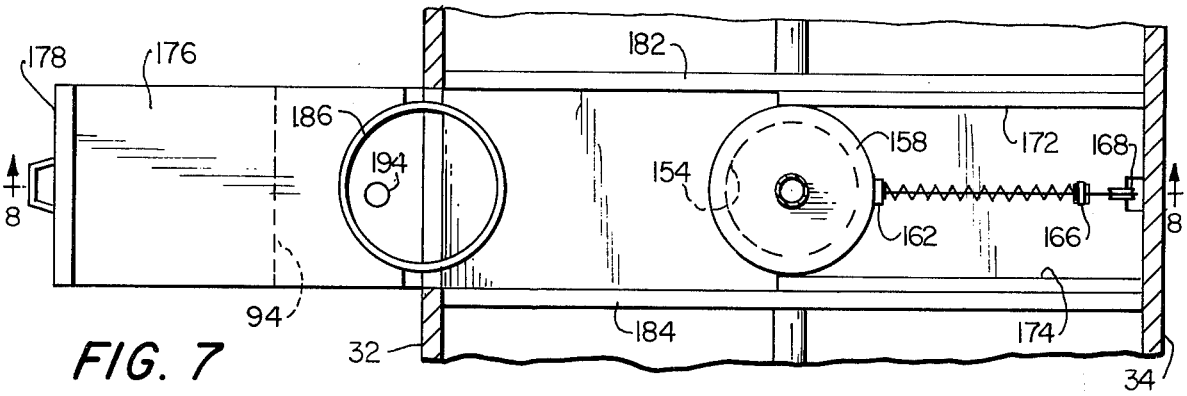
FIG. 7 is a sectional view in top plan similar to FIG. 5 but showing one of the drawers moved to the left.
Figure 8:
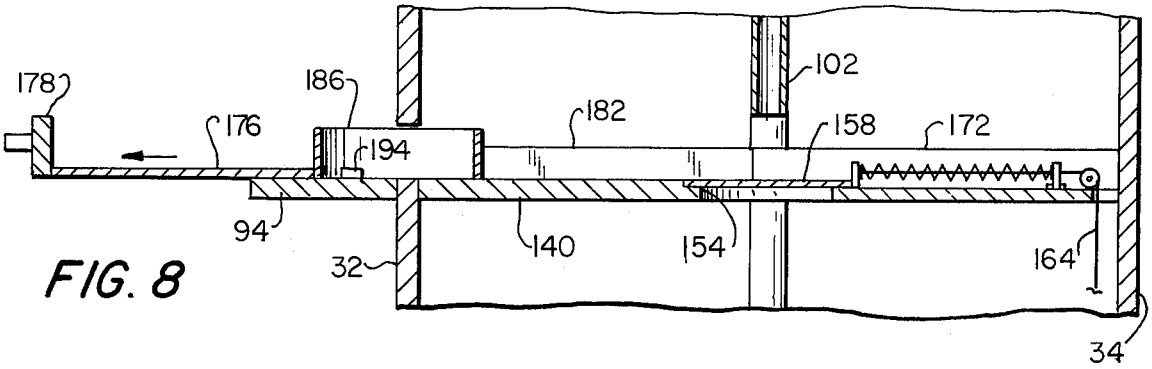
FIG. 8 is a sectional view in elevation taken along lines 8—8 in FIG. 7.

In order to ascertain how many projectiles have landed in any one of the projectile receiving assemblies 25, the player sequentially pulls each of the drawers 23 outwardly, as shown in FIGS. 7 and 8 from the position shown in FIG. 6 so that the projectile 194 located in the receiving assembly is visible from the front of the upstanding front wall 32. That is, the drawer 76 shown in FIG. 6 is pulled outwardly by handle 180 so that the housing 186 is moved from its first position below tube 102 to a second position in which it partially extends past the upstanding front wall 32 and the projectile 194 therein is visible to the player. Since the bottom member 158 remains in the position shown in FIG. 6, the projectile 194 slides across the top of the intermediate support member 140 and then outwardly onto the shelf 94 so provided. After all of the projectiles in the projectile receiving assemblies 25 have been counted and all of the drawers returned to their FIG. 6 position, the catch pan 90 is pulled outwardly and the projectiles in the right and left sections 148, 150 are counted.

Figure 9:
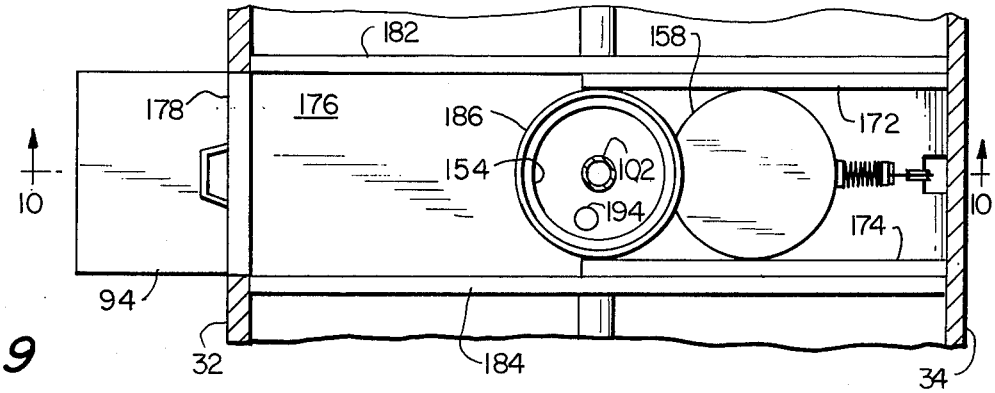
FIG. 9 is a sectional view in top plan similar to FIG. 7 but showing a bottom member moved to the right.
Figure 10:
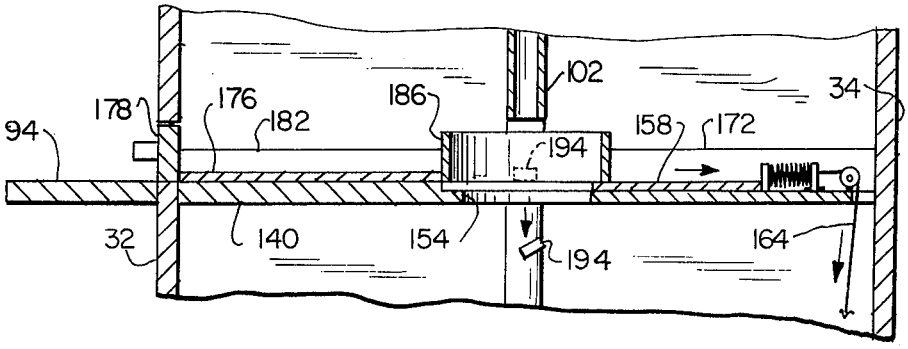
FIG. 10 is a sectional view in elevation taken along lines 10—10 in FIG. 9.

With all of the drawers and the catch pan returned to their initial positions, the handle 92 attached to cord 164 is pulled, thereby pulling towards the rear wall 34 all of bottom members 158. This opens the previously closed bottom ends of the housings 186 for each of the projectile receiving assemblies and all of the projectiles therein drop under the force of gravity through the aligned apertures 154 in all of the intermediate support members 140 so that all of these projectiles fall into the center section 152 of the catch pan 90, as shown in FIGS. 4, 9 and 10.

After the handle 92 is released, all of the bottom members 158 return to their FIG. 6 position and the catch pan 90 can be pulled outwardly from the upstanding front wall 32 and all of the projectiles can be easily retrieved therefrom. The next player of the game can then proceed.

Thus, an enjoyable game utilizing a plurality of target orifices at which a plurality of projectiles are sequentially thrown is provided in which the score for each player is easily determined and the retrieval of the plurality of projectiles is accomplished quickly.

While one advantageous embodiment has been chosen to illustrate the invention, it will be understood by those skilled in the art that various changes and modifications can be made therein without departing from the scope of the invention as defined in the appended claims.

What is claimed is:

1. An amusement apparatus used in conjunction with projectiles thrown toward the apparatus, the combination comprising:

a substantially horizontal base wall;

an upstanding wall coupled to said base wall;

a plurality of target orifices located in said upstanding wall at which a plurality of projectiles are sequentially thrown;

point value indicia associated with each of said target orifices;

a plurality of projectile receiving means, located above said base wall and below said target orifices, for receiving the projectiles passing through said target orifices, each one of said plurality of receiving means being associated with at least one of said target orifices;

channel means for selectively conducting projectiles passing through said target orifices from each of said target orifices into the receiving means associated therewith; and a plurality of drawer means, each for slidably supporting at least a part of one of said plurality of projectile receiving means between a first position wherein said part of said receiving means is on a first side of said upstanding wall and can receive a projectile from said channel means, and a second position wherein said part of said receiving means at least partially extends past the second side of said upstanding wall and projectiles therein are visible, each of said drawer means having point value indicia associated therewith corresponding to the point value indicia associated with the target orifice associated with the receiving means slidably supported thereby.

2. An amusement apparatus according to claim 1, wherein said target orifices are circular.

3. An amusement apparatus according to claim 1, wherein said target orifices are horizontally elongated slots.

4. An amusement apparatus according to claim 1, wherein each of said plurality of projectile receiving means includes a container formed of an upstanding open ended housing and a bottom member slidably positioned below and closing the bottom open end of said housing.

5. An amusement apparatus according to claim 4, wherein said apparatus further includes a plurality of spaced, horizontally oriented intermediate support members extending from said upstanding wall, each of said plurality of drawer means includes a plate slidably supported on the top of a support member, and a handle coupled to one end of said plate, and each of said receiving means housings is coupled to the other end of one of said plates.

6. An amusement apparatus according to claim 1, wherein said channel means includes a plurality of tubes, each of which is mounted adjacent a target orifice at one end and in a position at the other end to guide a projectile passing therethrough into the receiving means associated with the target orifice.

7. An amusement apparatus according to claim 1, and further including a catch pan slidably received in said upstanding wall and extending below said plurality of receiving means, and ejection means for ejecting from each of said receiving means the projectiles located therein so that the projectiles fall by gravity into said catch pan for convenient retrieval.

8. An amusement apparatus according to claim 7, wherein each of said receiving means includes an upstanding open ended housing and a bottom member slidably positioned to open and close the bottom open end of said container, and said ejection means comprises cord means for connecting said bottom member in each of said receiving means with a handle, wherein slidable movement to an extended position of said handle moves said bottom members away from their position closing the bottom open end of said housings.

9. An amusement apparatus according to claim 8, wherein said ejection means further includes a plurality of bias restoring means for restoring said bottom members to their positions closing the bottom open ends of said housings when said handle is released from its extended position.

10. An amusement apparatus according to claim 1, wherein some of said plurality of target orifices have the same point value indicia associated therewith, and said channel means includes a plurality of tubes, each extending from one of said target orifices having the same point value indicia and communicating with a main tube, said main tube having an end located above one of said receiving means.

* * * * *